US010926559B2

(12) United States Patent
Masunaga

(10) Patent No.: US 10,926,559 B2
(45) Date of Patent: Feb. 23, 2021

(54) MEDIUM-CUTTING DEVICE, IMAGE FORMING APPARATUS, AND METHOD FOR CONVEYING MEDIUM

(71) Applicant: RICOH COMPANY, LTD., Tokyo (JP)

(72) Inventor: Suguru Masunaga, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 630 days.

(21) Appl. No.: 15/619,826

(22) Filed: Jun. 12, 2017

(65) Prior Publication Data

US 2017/0368849 A1 Dec. 28, 2017

(30) Foreign Application Priority Data

Jun. 27, 2016 (JP) ..... JP2016-126794
Apr. 25, 2017 (JP) ..... JP2017-086136

(51) Int. Cl.

| | |
|---|---|
| ***B41J 11/70*** | (2006.01) |
| ***B65H 35/00*** | (2006.01) |
| ***B26D 1/06*** | (2006.01) |
| ***B41J 11/00*** | (2006.01) |
| *B41J 3/407* | (2006.01) |
| *B26D 7/00* | (2006.01) |
| *B26D 7/26* | (2006.01) |
| *B26D 1/01* | (2006.01) |

(52) U.S. Cl.

CPC ..... *B41J 11/703* (2013.01); *B26D 1/065* (2013.01); *B41J 11/005* (2013.01); *B65H 35/0086* (2013.01); *B26D 1/015* (2013.01); *B26D 7/0006* (2013.01); *B26D 7/26* (2013.01); *B41J 3/4075* (2013.01); *B41J 11/007* (2013.01); *B41J 11/0045* (2013.01); *B41J 11/706* (2013.01); *B65H 35/008* (2013.01)

(58) Field of Classification Search

None

See application file for complete search history.

(56) References Cited

U.S. PATENT DOCUMENTS

| | | | | |
|---|---|---|---|---|
| 4,152,962 | A * | 5/1979 | Hendrischk | B26D 1/205 83/482 |
| 5,881,624 | A * | 3/1999 | Brugue | B26D 1/185 30/265 |
| 6,089,136 | A * | 7/2000 | Hinojosa | B26D 1/185 83/453 |
| 6,302,602 | B1 * | 10/2001 | Kiyohara | B26D 1/045 400/593 |
| 7,815,382 | B2 * | 10/2010 | Monclus | B26D 1/245 400/621 |
| 2012/0027495 | A1 * | 2/2012 | Mochida | B41J 11/703 400/621 |

(Continued)

FOREIGN PATENT DOCUMENTS

| | | |
|---|---|---|
| JP | 2009-214200 | 9/2009 |
| JP | 2012-115952 | 6/2012 |

*Primary Examiner* — Jill E Culler

(74) *Attorney, Agent, or Firm* — Oblon, McClelland, Maier & Neustadt, L.L.P.

(57) ABSTRACT

A medium-cutting device includes a medium-conveyance section to convey a medium in a medium-conveyance direction, a cutter to cut the medium conveyed by the medium-conveyance section, and a pushing part to push up a piece of the medium that is cut from the medium with the cutter.

19 Claims, 11 Drawing Sheets

(56) References Cited

U.S. PATENT DOCUMENTS

| | | | | |
|---|---|---|---|---|
| 2012/0139987 | A1* | 6/2012 | Maeyama | B26D 1/045 347/16 |
| 2012/0140011 | A1 | 6/2012 | Yamada et al. | |
| 2013/0195536 | A1* | 8/2013 | Yoshinuma | B26D 1/185 400/621 |
| 2017/0225493 | A1* | 8/2017 | Barco Oria | B41J 11/706 |

* cited by examiner

MEDIUM-CUTTING DEVICE, IMAGE FORMING APPARATUS, AND METHOD FOR CONVEYING MEDIUM

CROSS-REFERENCE TO RELATED APPLICATIONS

This patent application is based on and claims priority pursuant to 35 U.S.C. § 119(a) to Japanese Patent Application No. 2016-126794, filed on Jun. 27, 2016, and Japanese Patent Application No. 2017-086136, filed on Apr. 25, 2017, in the Japan Patent Office, the entire disclosures of which are hereby incorporated by reference herein.

BACKGROUND

Technical Field

Aspects of the present disclosure relate to a medium-cutting device, an image forming apparatus, and a method for conveying a medium.

Related Art

A sheet cutting apparatus to cut rolled sheet to a desired length is sometimes used with an image forming apparatus for forming images on a sheet-like recording medium. This type of image forming apparatus conveys a long rolled sheet (hereinafter, simply "rolled sheet") in a certain conveyance direction (hereinafter, "medium-conveyance direction") to form an image on the rolled sheet. The image forming apparatus operates the sheet cutting apparatus to cut the rolled sheet to a desired length.

The above-described sheet cutting apparatus includes a cutting mechanism to cut the rolled sheet in a direction perpendicular to the medium-conveyance direction of the rolled sheet. Some of the cutting mechanism of the sheet cutting apparatus includes a pair of circular blades. More recently in particular, a cutting mechanism configured using circular blades is widely used in inkjet-type image forming apparatuses that handle rolled sheets of a variety of different thicknesses and materials.

SUMMARY

In an aspect of this disclosure, there is provided a novel medium-cutting device that includes a medium-conveyance section to convey a medium in a medium-conveyance direction, a cutter to cut the medium conveyed by the medium-conveyance section, and a pushing part to push up a piece of the medium that is cut from the medium with the cutter.

In another aspect of this disclosure, there is provided an image forming apparatus that includes an image forming section to form an image on a medium, a medium-conveyance section to convey the medium to the image forming section in a medium-conveyance direction, a cutter to cut the medium, on which the image is formed by the image forming section, conveyed by the medium-conveyance section, a cutter holder to hold the cutter, and a pushing part disposed on the cutter holder to push up a piece of the medium that is cut from the medium with the cutter.

In still another aspect of this disclosure, there is provided a method for conveying a medium through an image forming apparatus. The method includes conveying a first medium and a second medium in a conveyance direction, the second medium being placed upstream of the first medium in the conveyance direction, bending a trailing end of the first medium by pushing up the trailing end of the first medium, conveying the second medium in the conveyance direction after bending the trailing end of the first medium, and pushing out the first medium with the second medium by contacting a leading end of the second medium with the trailing end of the first medium to convey the first medium.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
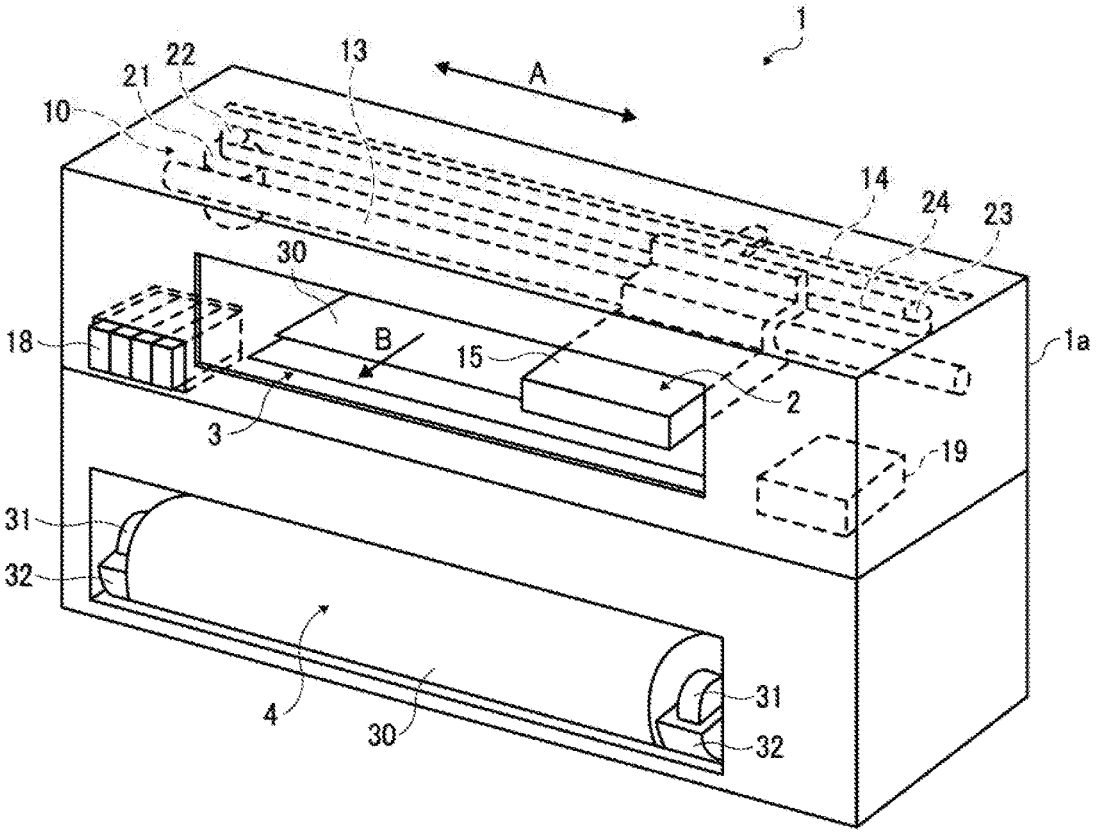
FIG. 1 is a schematic perspective view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

The present disclosure is related to a medium-cutting device for cutting a rolled sheet conveyed along a conveying path to a desired length. The medium-cutting device of the present disclosure includes a cutting mechanism that reciprocally moves in a sheet width direction of the rolled sheet to cut the rolled sheet. The medium-cutting device pushes up a trailing end of a piece of the rolled sheet that is cut from the rolled sheet. The medium-cutting device pushes up the trailing end of the piece when the cutting mechanism moves backward to a home position of the cutting mechanism in the sheet width direction of the rolled sheet.

Figure 2:
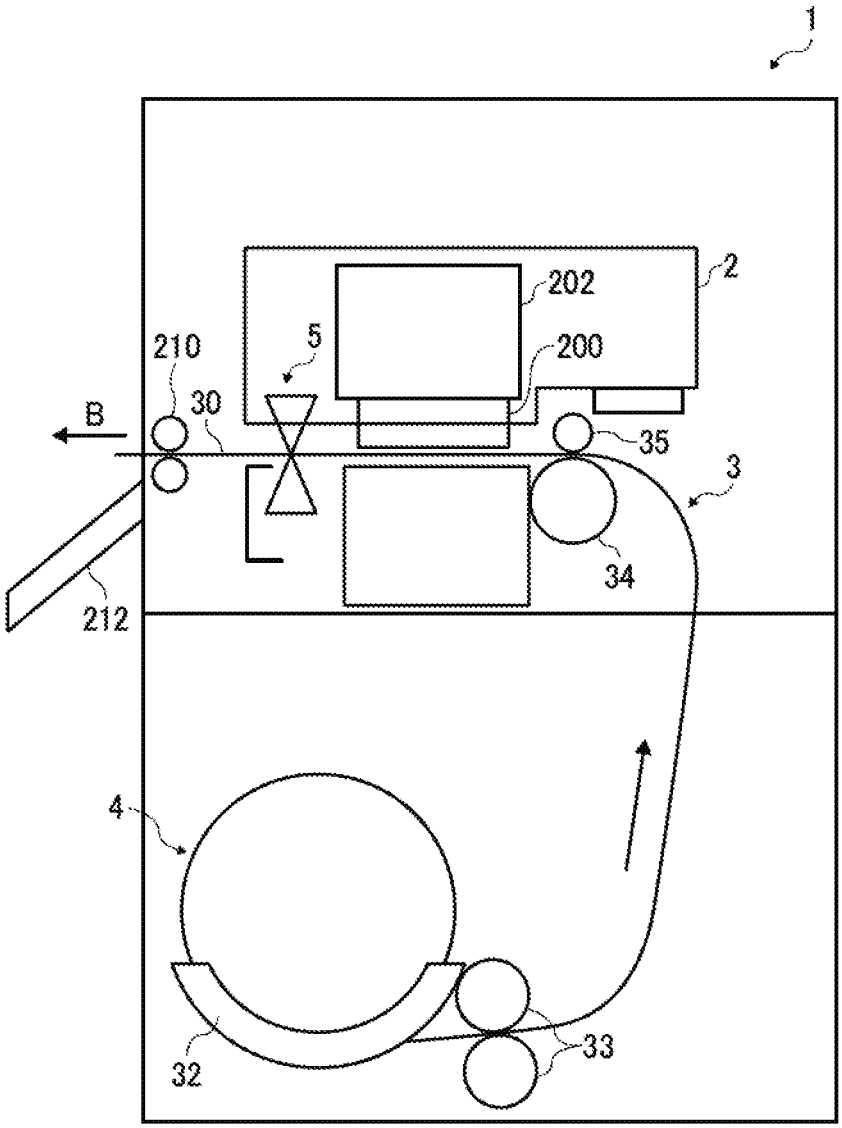
FIG. 2 is a schematic cross-sectional view of the image forming apparatus according to the embodiment of the present disclosure.

With reference to FIGS. 1 and 2, a description is given of a configuration of an image forming apparatus and a medium-cutting device according to an embodiment of the present disclosure.

FIG. 1 is a schematic view of an image forming apparatus according to an embodiment of the present disclosure. FIG. 2 is a schematic internal side view of the inkjet printer 1.

The image forming apparatus illustrated in FIG. 1 is a serial-type inkjet printer 1. The inkjet printer 1 illustrated in FIGS. 1 and 2 is an image forming apparatus that uses a rolled sheet 30 as a sheet-like recording medium. The inkjet printer 1 includes an image forming section 2, a medium-conveyance section 3, a rolled sheet storage section 4, and a medium-cutting device 5. The image forming section 2, the medium-conveyance section 3, the rolled sheet storage section 4, and the medium-cutting device 5 are disposed within an apparatus body 1*a* of the inkjet printer 1.

The image forming section 2 includes a guide rod 13 and a guide rail 14 that extend between side plates of the apparatus body 1*a*. The image forming section 2 includes a carriage 15 slidably supported by the guide rod 13 and the guide rail 14. The carriage 15 reciprocally moves (scans) in a main scanning direction (sheet width direction) indicated by an arrow A in FIG. 1.

The carriage 15 mounts liquid discharge heads (recording heads) 200 to discharge droplets of ink of different colors, e.g., black (K), yellow (Y), magenta (M), and cyan (C). Sub tanks 202 are integrally molded with the corresponding recording heads 200 to supply color inks to the respective recording heads 200.

A main scanning mechanism 10 moves the carriage 15 for scanning in the main scanning direction indicated by double-headed arrow A in FIG. 1. Here, the main scanning direction is a sheet width direction of the rolled sheet 30.

The main scanning mechanism 10 includes a drive motor 21 disposed at a first end in the sheet width direction A. The main scanning mechanism 10 includes a driving pulley 22 rotated by the drive motor 21, a driven pulley 23 disposed at a second end opposite the first end in the sheet width direction A, and a belt member 24 entrained around the driving pulley 22 and the driven pulley 23.

A tension spring tensions the driven pulley 23 outward, that is, away from the driving pulley 22. A portion of the belt member 24 is fixed to and held by a belt fixing portion at a rear side of the carriage 15 to draw the carriage 15 in the sheet width direction A. To detect a main scanning position of the carriage 15 in the main scanning direction, an encoder sheet is disposed along the sheet width direction (main scanning direction) A in which the carriage 15 moves. An encoder sensor is disposed at the carriage 15 and reads the encoder sheet to detect the main scanning position of the carriage 15.

In a recording area of a main scanning region of the carriage 15, the rolled sheet 30 is intermittently conveyed by the medium-conveyance section 3 in a medium-conveyance direction indicated by arrow B in FIG. 1. The medium-conveyance direction indicated by arrow B is a direction perpendicular to the sheet width direction (main scanning direction) indicated by arrow A in FIG. 1.

Outside the range of movement of the carriage 15 in the sheet width direction A or at a first end side of the main scanning region of the carriage 15, main cartridges 18 are detachably mounted to the apparatus body 1*a* to store the respective color inks to be supplied to the sub tanks 202 of the recording heads 200. At a second end side of the main scanning region opposite the first end side, a maintenance unit 19 is disposed to maintain the recording heads 200 in good condition.

The rolled sheet storage section 4 serves as a sheet storing unit into which the rolled sheet 30 is set. The rolled sheet 30 is a recording medium serving as sheet for image recording. Rolled sheet of different widths can be set to the rolled sheet storage section 4. The rolled sheet 30 includes a sheet shaft and flanges 31 that are mounted at opposed ends of the sheet shaft. By mounting the flanges 31 to flange bearings 32 of the rolled sheet storage section 4, the rolled sheet 30 is stored in the rolled sheet storage section 4. The flange bearings 32 include support rollers to rotate the flanges 31 while contacting the outer circumferences of the flanges 31 to convey the rolled sheet 30 to a medium-conveyance path.

The inkjet printer 1 according to the present embodiment discharges ink droplets onto the rolled sheet 30 while moving the carriage 15 in a sheet width direction A of the rolled sheet 30 (main canning direction) relative to the rolled sheet 30, thereby forming an image on the rolled sheet 30. An image is formed on the rolled sheet 30 by seaming the carriage 15 in the sheet width direction A once or multiple times. The rolled sheet 30, on which the image is formed, is conveyed in the medium-conveyance direction indicated by the arrow B in FIG. 1. The medium-cutting device 5 cuts the rolled sheet 30 conveyed in the medium-conveyance direction B to a desired length. Apiece of the rolled sheet 30 cut by the medium-cutting device 5 is output outside the apparatus body 1*a*. Note that the medium-cutting device 5 is detachably mounted to the Inkjet printer 1.

The inkjet printer 1 in the present embodiment is not limited to the serial type described above. Thus, for example, the inkjet printer 1 can be a line-head-type inkjet recording apparatus. The line-head-type inkjet recording apparatus includes one long bar-like recording head 200 or a plurality of recording heads 200 extending the entire width of the recording region of the sheet, in the width direction A of the rolled sheet 30. The recording head in such a configuration includes a plurality of nozzles, from which the liquid ink is discharged. The line-head-type inkjet recording apparatus forms an image on the rolled sheet 30 while remaining stationary, without scanning the carriage 15 in the main scanning direction while conveying the sheet to the recording head 200.

It is to be noted that although rolled sheet 30 is used for the recording medium in the present embodiment, the type of recording medium is not limited to the rolled sheet 30. The sheet-like medium that can be used for the medium-cutting device 5 according to the present disclosure is not limited to the recording medium such as a sheet. The sheet-like medium may be a sheet-like member such as an overhead projector (OHP) sheet, a prepreg, or copper foils, for example. That is, any sheet-like medium can be used for the medium-cutting device 5 according to present embodiment if the sheet-like medium can be cut while being conveyed and ejected to the medium-cutting device 5.

The medium-cutting device 5 is mounted in the inkjet printer 1 as illustrated in FIG. 2. As illustrated in FIG. 2, the medium-conveyance section 3 includes a pair of feed rollers 33, a conveyance roller 34, and a registration pressure roller 35. The pair of feed rollers 33 feed the rolled sheet 30 from the rolled sheet storage section 4 to the medium-conveyance path. The conveyance roller 34 and the registration pressure roller 35 are disposed in an upstream side of the image forming section 2 in the medium-conveyance direction. The conveyance roller 34 and the registration pressure roller 35 are disposed opposite each other and in contact with each other. The inkjet printer 1 conveys the rolled sheet 30 between the conveyance roller 34 and the registration pressure roller 35 and conveys the rolled sheet 30 to the medium-cutting device 5 via the image forming section 2.

The inkjet printer 1 conveys the rolled sheet 30 by the medium-conveyance section 3 from the rolled sheet storage section 4 to a predetermined recording area positioned below the image forming section 2 from the backside of the apparatus body 1*a* (the direction opposite the arrow B in FIG. 2) toward front side of the apparatus body 1*a* (the direction toward arrow B). When the rolled sheet 30 is conveyed to the recording area, the carriage 15 scans in the sheet width direction (main scanning direction) A and the recording heads (liquid discharge heads) 200 discharges ink droplet from the recording heads 200 according to the image information. The inkjet printer 1 forms an image of each recording lines on the rolled sheet 30 by repeating an operation of discharging the ink droplet from the recording heads 200 while intermittently conveying the rolled sheet 30 to the image forming section 2. Finally, the inkjet printer 1 forms a desired image according to the image information on the rolled sheet 30.

The inkjet printer 1 cuts the rolled sheet 30, on which the image is formed, with the medium-cutting device 5. Further, the inkjet printer 1 ejects the rolled sheet 30, which is cut by the medium-cutting device 5, to an ejection tray 212 disposed at a front side of the apparatus body 1*a* via ejection rollers 210.

Next, a description is given of a configuration of the medium-cutting device 5 according to an embodiment of the present disclosure.

Figure 3:
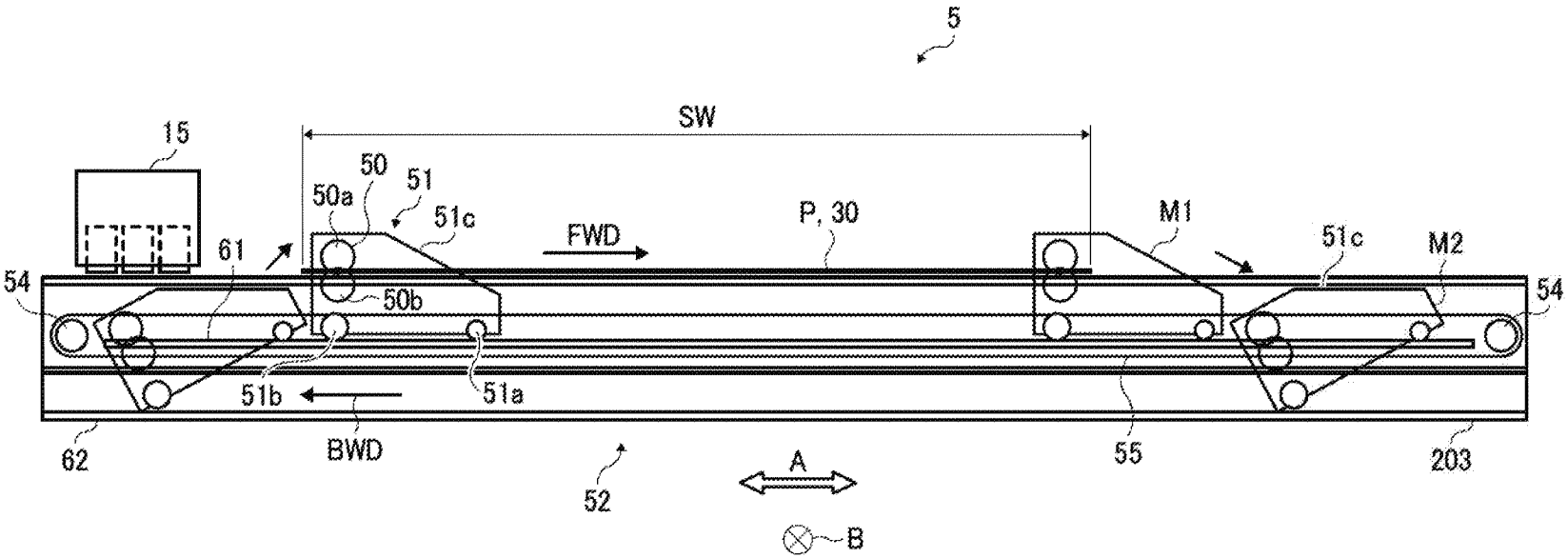
FIG. 3 is a front view of a medium-cutting device according to an embodiment of the present disclosure.

FIG. 3 is a schematic front view of medium-cutting device 5 according to the present embodiment. Here, "front view" indicates a view from a downstream side (from the ejection tray 212 side) of the apparatus body 1*a* in the medium-conveyance direction B of the rolled sheet 30 as a sheet-like member.

As illustrated in FIG. 2, the medium-cutting device 5 is disposed at downstream side of the image forming section 2 in the medium-conveyance direction B. The medium-cutting device 5 includes a cutter 50, a cutter holder 51, and a cutter guide 52. The cutter 50 cuts the rolled sheet 30 to a sheet-like shape. The cutter holder 51 holds the cutter 50 and moves in the sheet width direction (main scanning direction) A. The cutter guide 52 forms a pathway 203 of the cutter holder 51 to guide movement of the cutter holder 51.

The cutter 50 is formed with circular blades 50*a* and 50*b*. Two circular blades 50*a* and 50*b* are disposed opposing each other and rotatably held by the cutter holder 51. With movement of the cutter holder 51 in the sheet width direction indicated by an arrow A in FIG. 3, the circular blades 50*a* and 50*b* receive a driving force to rotate. In other words, the cutter 50, while rotating the circular blades 50*a* and 50*b*, cuts the rolled sheet 30 and thus is capable of cutting, e.g., a relatively thick rolled sheet.

The cutter 50 is formed with the circular blades 50*a* and 50*b*, thus preventing such failures as intensive wearing of only a particular portion of the blade, which readily occurs with a stationary blade. It is to be noted that the number of circular blades is not limited to two and thus the cutter 50 may have a single circular blade or three or more circular blades. In this exemplary embodiment, there are two circular blades 50*a* and 50*b*.

The cutter holder 51 can be reciprocally moved in the sheet width direction (main scanning direction) A of the rolled sheet 30 along the pathway 203. The pathway 203 includes a rail member such as an upper guide rail 61 and a lower guide rail 62 to slidably guide the cutter holder 51. When the cutter holder 51 moves along a forward path (indicated by an arrow FWD in FIG. 3) from the second end side to the first end side of the apparatus body 1*a*, the circular blades 50*a* and 50*b* of the cutter 50 moves while sandwiching the rolled sheet 30 with the circular blades 50*a* and 50*b*. Thereby, the cutter 50 cuts the rolled sheet 30.

The cutter 50 is disposed inside the rail member provided along the sheet width direction (main scanning direction) A. The sheet width direction (Hereinafter, guide direction) is a direction perpendicular to the medium-conveyance direction B, along which the rolled sheet 30 is conveyed. The cutter 50 cuts the rolled sheet 30 while moving in the sheet width direction (main scanning direction) A.

By contrast, the cutter holder 51 moves from the first end side to the second end side of the apparatus body 1*a* to return to an initial position (hereinafter, "home position") along a backward path (indicated by an arrow BWD in FIG. 3). In backward path BWD, the cutter holder 51 moves along a path different from the forward path FWD. The backward path BWD is formed at a position retracted from the medium-conveyance path vertically downward. The cutter holder 51 moves to the home position along the backward path BWD after the cutter 50 cuts the rolled sheet 30.

The backward path BWD is formed separate from the medium-conveyance path (indicated by a solid line P in FIG. 3) in a vertically downward direction from a conveying surface of the medium-conveyance path of the rolled sheet 30. Therefore, the cutter holder 51 does not block the medium-conveyance path when the cutter holder 51 moves along the backward path BWD. The position of the cutter holder 51 is detected with detectors, e.g., micro switches, disposed at opposed ends in the sheet width direction A and controlled based on readings from the detectors so that the cutter holder 51 moves in the way described above.

The specific configuration of the cutter holder 51 is described in further detail below.

The cutter holder 51 includes a drive roller 51*a* and a driven roller 51*b* and holds the cutter 50 (circular blades 50*a* and 50*b*) inside. The drive roller 51*a* is connected to a wire 55. The wire 55 is wound around a pair of pulleys 54 disposed at the opposed end sides of the apparatus body 1*a* in the sheet width direction A. Further, the drive motor 21 rotates the pulleys 54 to rotate and move the wire 55 in the sheet width direction A. Thus, the drive roller 51*a* chives and rotates along and on the upper guide rail 61 according to the rotational movement of the wire 55. The upper guide rail 61 is described below.

The cutter holder 51 can be moved inside the pathway 203 by a rotational driving force of the drive roller 51*a*. The pathway 203 is provided across the sheet width direction A of the rolled sheet 30. The driven roller 51*b* is rotatable at a position away from the drive roller 51*a* in the sheet width direction A. The driven roller 51*b* moves along the upper guide rail 61 when the cutter holder 51 moves along the forward path FWD. On the other hand, the driven roller 51*b* moves along the lower guide rail 62 when the cutter holder 51 moves along the backward path BWD. The driven roller 51*b* acts as a positioning member to position the cutter holder 51 to the upper guide rail 61 or the lower guide rail 62 when the cutter holder 51 moves.

Here, the member that positions the cutter holder 51 is not limited to the driven roller 51*b*, but also be other members such as a circular-shaped protrusion. The driven roller 51*b* of the present embodiment acts as a positioning member of the present disclosure.

The cutter holder 51 rotates vertically downward around the drive roller 51*a* as a rotation axis when the cutter holder 51 changes from the forward path FWD to the backward path BWD. Thereby, the cutter holder 51 changes its positions between the cutting position when the cutter 50 cuts the roiled sheet 30 in the forward path FWD and the retracted position when the cutter holder 51 is retracted away from the medium-conveyance path in the backward path BWD. In FIG. 3, the cutting position to cut the rolled sheet 30 is indicated by reference numeral M1 (cutting mode as described below), and the retracted position in which the cutter holder 51 is retracted from, the medium-conveyance path is indicated by reference numeral M2 (pushing mode as described below).

As illustrated in FIG. 3, the cutter holder 51 has a slanted face 51*c* slanted at a predetermined angle from the medium-conveyance path (indicated by the solid line P) toward the vertical direction. The slant angle of the slanted face 51*c* is set so that the slanted face 51*c* is parallel to the sheet feed path when the cutter holder 51 moves along the backward path BID.

Here, it is described below the examples of problems that may occur in a medium-cutting device.

Figure 4A:
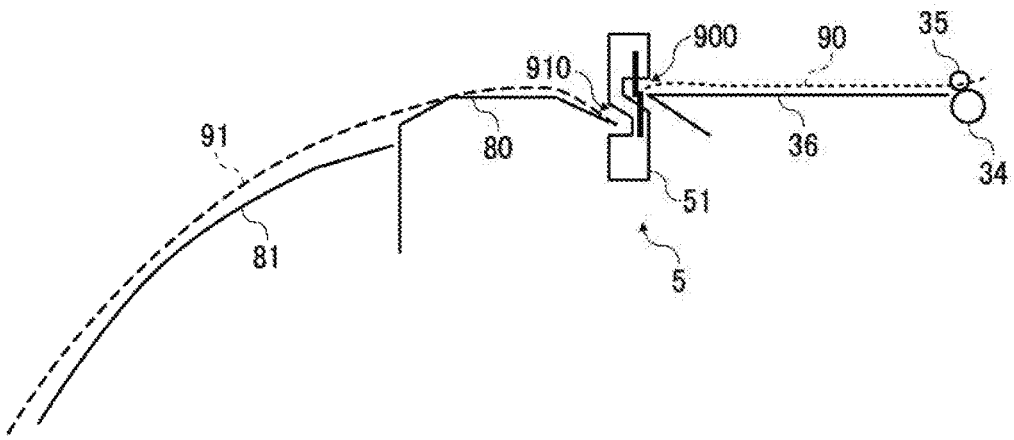
FIGS. 4A and 4B are side views of an example of a medium-cutting device.
Figure 4B:
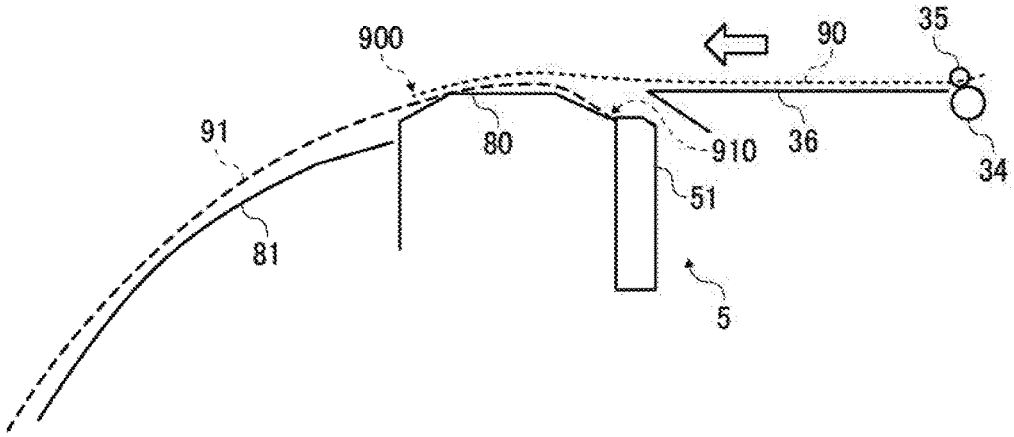

FIGS. 4A and 4B illustrate an example of a medium cutting process executed by a comparative example of a medium-cutting device. Here, for convenience only, the same reference numerals are used for elements that have a configuration similar to the inkjet printer 1 and the medium-cutting device 5 of the present embodiment described above.

FIG. 4A illustrates a cutting process in which the cutter holder 51 cuts the rolled sheet 30 in the forward path FWD. As illustrated in FIG. 4A, the rolled sheet 30 is nipped and conveyed by the conveyance roller 34 and the registration pressure roller 35 while suctioned by a platen 36. A trailing end 910 of the cut sheet 91 (cut piece), which is a side cut off from the rolled sheet 30, hangs down to a pathway side of the cutter holder 51 along an ejection guide plate 80. The trailing end 910 of the cut sheet 91 (cut piece) is an upstream end of the cut sheet 91 in the medium-conveyance direction B.

FIG. 4B illustrates the status where the cutter holder 51 returns to the home position through the backward path BWD after cutting the rolled sheet 30. When the cutter holder 51 moves along the backward path BWD, the rolled sheet 30 is conveyed to a position to perform subsequent processes such as an image forming process and a cutting process. At this time, the rolled sheet 30 is intermittently conveyed to the medium-cutting device 5. When the rolled sheet 30 is conveyed to reach to a next cutting position, the cutter 50 cuts the rolled sheet 30 while the cutter holder 51 moves along the forward path FWD.

When the rolled sheet 30 is conveyed to the next cutting position, a leading end 900 of the next-conveyed sheet 90 is easily piled on the cut sheet 91 that remains on the ejection guide plate 80 or an ejection guide cover 81. The leading end 900 of the next-conveyed sheet 90 is a downstream end of the next-conveyed sheet 90 in the medium-conveyance direction B. In this condition, the nest-conveyed sheet 90 contacts and piles on the cut sheet 91, which has been cut from the rolled sheet 30, from the trailing end 910 of the cut sheet 91 toward front side of the apparatus body 1*a* (toward the ejection guide plate 80 and the ejection guide cover 81).

In particular, when static electricity is readily discharged under conditions of low temperature and low humidity, the cut sheet 91 sticks to the ejection guide plate 80 or an ejection guide cover 81. Thus, the cut sheets 91 becomes not easily being ejected while remaining at the ejection guide plate 80 piled up one after another even when a force is applied in an ejection direction (medium-conveyance direction B) by a conveying force of the nest-conveyed sheet 90.

In this way, if the next-conveyed sheet 90 is contacted with and piled on the cut sheet 91 while conveying the next-conveyed sheet 90, ink on the cut sheet 91 is still wet and is transferred to the next-conveyed sheet 90. As the rolled sheet 30 becomes smaller and curling occurs, the trailing end 910 of the cut sheet 91 readily contacts the ejection guide plate 80, and the ink on the cut sheet 91 may be transferred to the ejection guide plate 80 as a result.

Figure 5A:
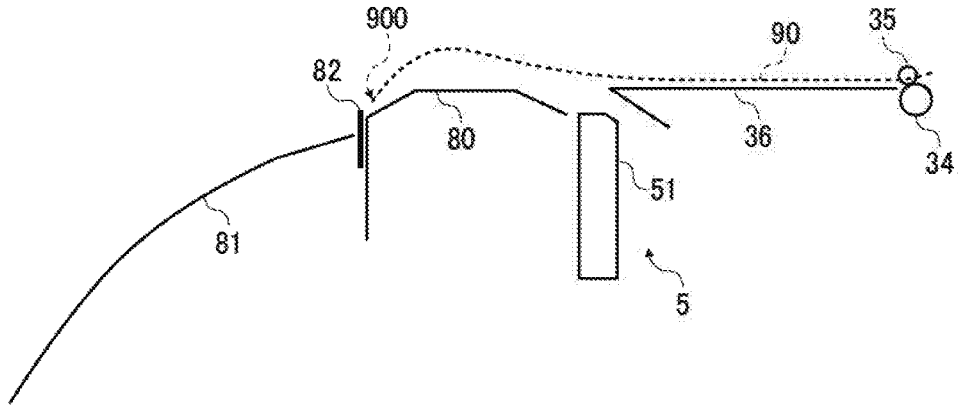
FIGS. 5A and 5B are side views of an example of a medium-cutting device.
Figure 5B:
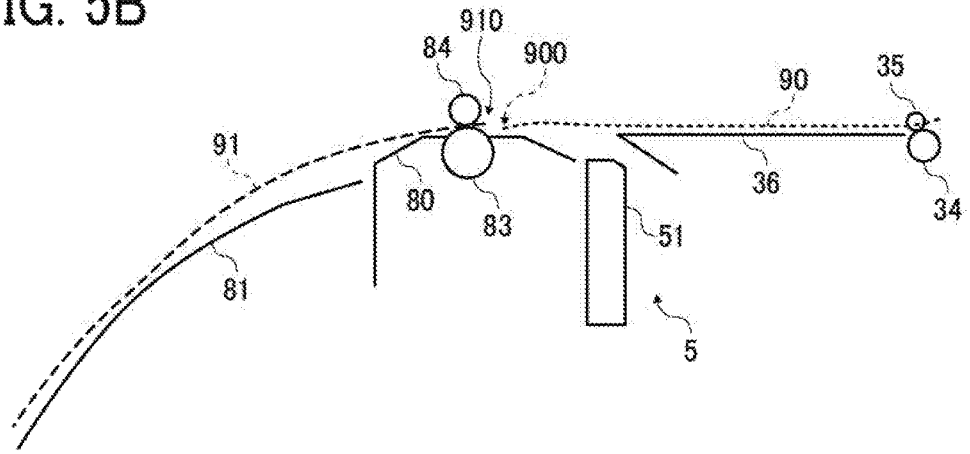

FIGS. 5A and 5B illustrate examples of measures that may solve the above described problems. As illustrated in FIG. 5A, it is possible to provide a discharge brush 82 on the ejection guide plate 80 to remove static electricity. The discharge brash 82 may prevent the cut sheet 91 sticking on the ejection guide plate 80 due to static electricity. However, if the shape of the top end of the discharge brush 82 is deformed over time, the next-conveyed sheet 90 is easily caught by the discharge brash 82 causing jamming of the cut sheet 91. Further, manufacturing cost may be increased by providing the discharge brush 82. The discharge brush 82 may affect the appearance of the apparatus body 1*a*.

As illustrated in FIG. 5B, the ejection guide plate 80 may be provided with an ejection roller 83 and a spur 84. The spur 84 is disposed opposite the ejection roller 83. However, the spur 84 may disturb the image formed on the cut sheet 91. Further, a jam may occur if the leading end 900 of the next-conveyed sheet 90 lodges between the ejection roller 83 and the spur 84. Further, manufacturing cost may be increased by separately providing the ejection roller 83 and the spur 84.

The medium-cutting device 5 and image forming apparatus of the present embodiment has the cutter holder 51 to solve the problems as describe in FIGS. 4A and 4B. The cutter holder 51 of the present embodiment has two pathways consisting of a forward path FWD and a backward path BWD different with each other. Further, the cutter holder 51 pushes up the trailing end 910 of the cut sheet 91 while moving along the backward path BWD.

A description is now given of a cutting operation and a pushing operation and effects of the medium-cutting device 5 according to an embodiment of the present disclosure.

Figure 6A:
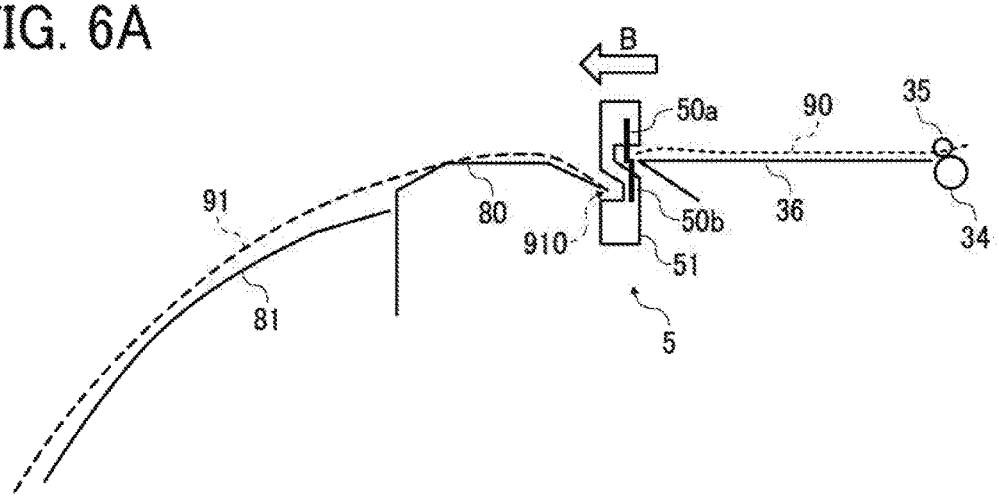
FIGS. 6A to 6C are schematic side views of a medium-cutting device according to an embodiment of the present disclosure.
Figure 6B:
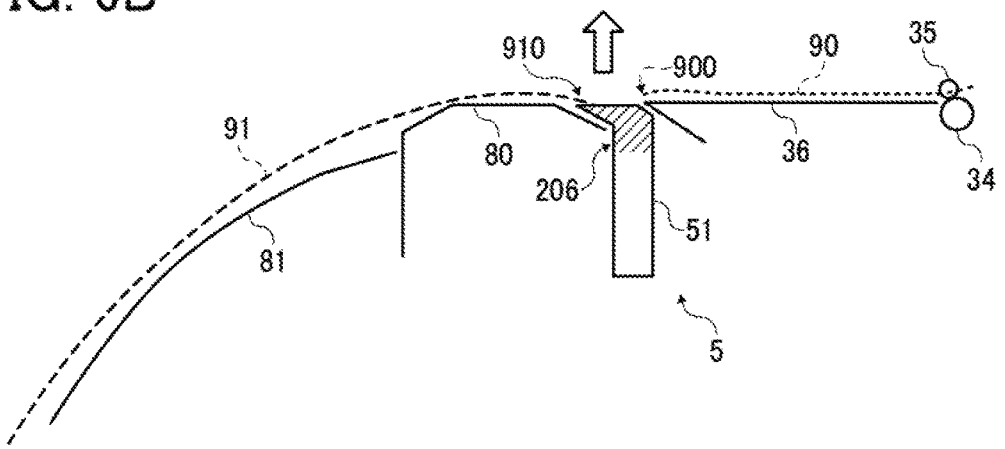
Figure 6C:
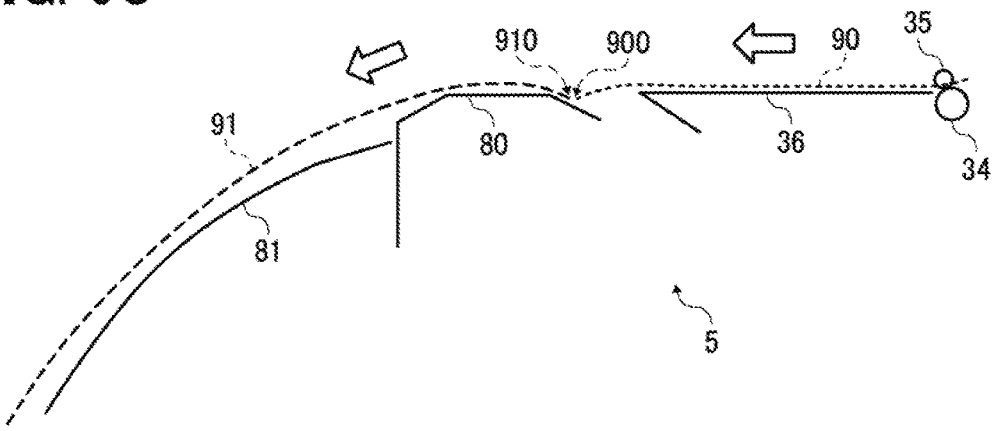

FIGS. 6A to 6C are schematic side views of a medium-cutting device 5 according to a present embodiment. FIG. 6A exemplary illustrates a state where the cutter holder 51 (and cutter 50) cuts the rolled sheet 30 while moving along the forward path FWD. At this time, the cutter holder 51 is in the cutting mode M1 as described below.

The height of the cutter 50 and the height of the rolled sheet 30 become the same in the cutting mode in FIG. 6A; i.e., they are flush. Thus, the cutter 50 can cut the rolled sheet 30.

As illustrated in FIGS. 6A to 6C, the cutter holder 51 includes a pushing part 206 in addition of the circular blades 50*a* and 50*b* of the cutter 50. The pushing part 206 supports a piece of the cut sheet 91 of the rolled sheet 30 cut from the rolled sheet 30 from the bottom of the cut sheet 91. A specific pushing process of the pushing part 206 is further described below. The piece of the rolled sheet 30 cut from the rolled sheet 30 is a cut piece referred to as a cut sheet 91 described below.

The cutter holder 51 can change between the two modes of a cutting mode M1 and a pushing mode M2. The cutting mode M1 is for cutting the rolled sheet 30 by the cutter 50. The pushing mode M2 is for pushing the cut piece of the cut sheet 91 upward with the pushing part 206. Here, the "modes" of the cutter holder 51 refers to a status including such attributes as shape, attitude, position, height, etc. of the cutter holder 51. In the present embodiment, the cutter holder 51 changes modes by changing the position and the attitude of the cutter holder 51. For example, if the pushing part 206 is provided inside the cutter 50, mode change can be performed by exposing the pushing part 206 outside the cutter 50 with a device such as a motor.

The object that the pushing part 206 pushes is not limited to the cut sheet 91. Thus, for example, the pushing part 206 may push a next-conveyed sheet 90 that is not cut by the cutter 50.

In the following description, if not specially mentioned, the term "cut sheet 91" refers to a medium cut from the rolled sheet 30, and "medium" refers to medium that has not been cut from the rolled sheet 30. Further, "a medium that has not been cut from the rolled sheet" is a medium that is positioned on the upstream side of the cut sheet 91 in the medium-conveyance direction and is a medium that can push the cut sheet 91 in the medium-conveyance direction.

Here, the cutter holder 51 reciprocally moves inside the pathway 203 that is provided along the sheet width direction (main scanning direction) A. The pathway 203 may be a groove or gap large enough to accommodate the cutter holder 51, for example. The pathway 203 is disposed between the platen 36 and the ejection guide plate 80 in the medium-conveyance direction B in the present embodiment. The location of the pathway 203 is not limited to the location described above if the pathway 203 is provided at any place on a guide path of a guide member. The guide member includes the platen 36, the ejection guide plate 80, and the ejection guide cover 81 in the present embodiment.

As illustrated in FIG. 6A, the rolled sheet 30 is nipped and conveyed by the conveyance roller 34 and the registration pressure roller 35 in a guide direction (medium-conveyance direction) B while suctioned by a platen 36. Thereby, the rolled sheet 30 is conveyed to the medium-cutting device 5 such that the rolled sheet 30 travels across the pathway 203. The cutter holder 51 moves along the pathway 203 when the rolled sheet 30 is conveyed in the medium-conveyance direction B for a predetermined length. Thereby, the cutter 50 cuts the rolled sheet 30. The trailing end 910 of the cut sheet 91 hangs down toward a lower side of the pathway 203 along an ejection guide plate 80. The trailing end 910 of the cut sheet 91 is a piece of the rolled sheet 30 cut from the rolled sheet 30.

FIG. 6B illustrates a state where the pushing part 206 of the cutter holder 51 pushes the trailing end 910 of the cut sheet 91. The pushing part 206 of the cutter holder 51 pushes the trailing end 910 of the cut sheet 91 with a top surface of the cutter holder 51 when the cutter holder 51 moves along the backward path BWD. The pushing part 206 of the cutter holder 51 pushes up the trailing end 910 of the cut sheet 91 from the position (height) where an upstream side of a taper-shaped part of the ejection guide plate 80 is located to the position (height) near the top face (flat face) of the ejection guide plate 80.

Thus, the pushing part 206 pushes the trailing end 910 of the cut sheet 91 to the position (height) where the rolled sheet 30 is cut by the cutter holder 51 while the cutter holder 51 moves along the backward path BWD. Thereby, even if the cut sheet sticks to the ejection guide plate 80 due to static electricity, the pushing part 206 of the cutter holder 51 pushes the trailing end 910 of the cut sheet 91 to separate the trailing end 910 from the ejection guide plate 80. Thereby, the cut sheet 91, the trailing end 910 of which is pushed by the cutter holder 51, is easily ejected along a slope of the ejection guide cover 81 by the force of gravity.

At this time, the cutter holder 51 is in the pushing mode M2 as described above.

Specifically, the height of the pushing part 206 of the cutter holder 51 in the pushing mode M2 is lower than the height of the cut sheet 91. Due to these relative positions, the pushing part 206 can push the trailing end 910 of the cut sheet 91 upward from the lower side of the cut sheet 91 while the cutter holder 51 moves along the backward path BWD of the pathway 203.

It is desired that the medium-cutting device 5 has a configuration such that the cutter 50 does not contact the rolled sheet 30 in the pushing mode M2.

If the cut sheet 91 is not ejected along the slope of the ejection guide cover 81 in a state illustrated in FIG. 6B, the leading end 900 of the next-conveyed sheet 90 pushes the trailing end 910 of cut sheet 91 in a medium-conveyance operation of the next-conveyed sheet 90 as illustrated in FIG. 6C. Thus, it is possible to prevent ejection jam occurred by piling of the next-conveyed sheet 90 on the cut sheet 91 because the cut sheet 91 is ejected according to the conveying operation of the next-conveyed sheet 90.

The effect described above may be obtained by conveying the next-conveyed sheet 90 after the ending of the movement of the cutter holder 51 in the backward path BWD. However; if the movement of the cutter holder 51 in the backward path BWD ends, the trailing end 910 of the cut sheet 91, which is temporarily pushed up by the cutter holder 51, hangs down to the taper side of the ejection guide plate 80 by the force of gravity. Therefore, it is more desirable to perform conveying operation of the next-conveyed sheet while the cutter holder 51 moves along the backward path BWD. In this case, because a friction load of the cut sheet 91 against the ejection guide plate 80 is small, it is easy to push the cut sheet 91 with the next-conveyed sheet 90.

Figure 7:
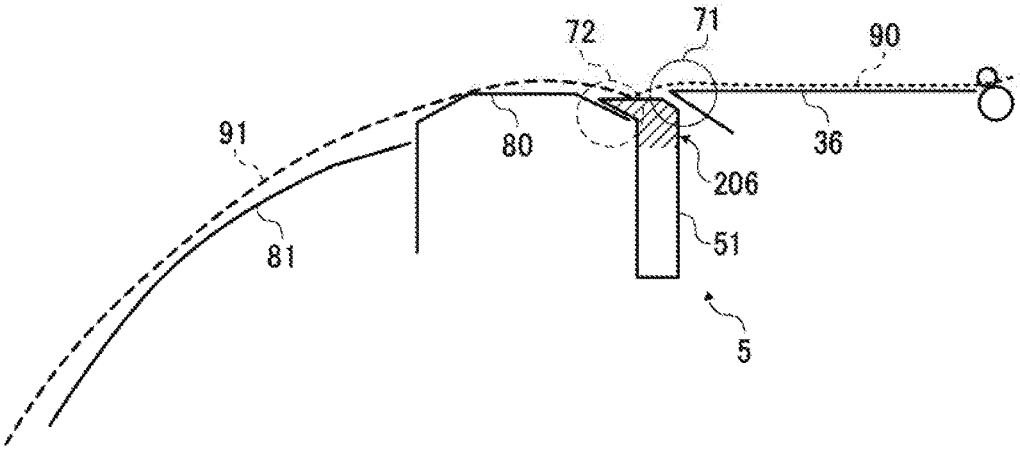
FIG. 7 is a schematic side view of the medium-cutting device according to another embodiment of the present disclosure.

FIG. 7 illustrates a state that the cutter holder 51 according to the present embodiment is in a second position. As illustrated in FIG. 7, the pushing part 206 in the present embodiment is disposed below a downstream end 71 of the upstream-side guide member (platen 36) as illustrated by a circle of solid line. Further, the pushing part 206 of the present embodiment disposed above the upstream end 72 of the downstream-side guide member (ejection guide plate 80) as illustrated by a circle of broken line. In other words, a top face of the pushing part 206 is dispose at the second position of the cutter holder 51. The second position is vertically lower than the downstream end 71 of the upstream-side guide member (platen 36) and is vertically higher that the upstream end 72 of the downstream-side guide member (ejection guide plate 80).

In the present embodiment, the upstream end of the pathway 203 is constituted by the end of the platen 36, and the downstream end of the pathway 203 is constituted by the end of the ejection guide plate 80.

Thus, the cutter holder 51 does not catch the next-conveyed sheet 90 while conveying the next-conveyed sheet 90 during the backward movement of the cutter holder 51. Further, the pushing part 206 of the cutter holder 51 push up the trailing end 910 of the cut sheet 91 while the cutter holder 51 moves along the backward path BWD. Thereby, the cutter holder 51 holds the trailing end 910 of the cut sheet 91 so that the leading end 900 of the next-conveyed sheet 90 contacts with the trailing end 910 of the cut sheet 91.

Especially, downstream side of an end face of the pushing part 206 has a function of scooping up the trailing end 910 of the cut sheet 91 from the tapered surface of the ejection guide plate 80, Thus, the pushing part 206 can push up the cut sheet 91 from the ejection guide plate 80. Thereby, the cutter holder 51 makes a condition such that the cut sheet 91 is easily pushed by the next-conveyed sheet 90.

The timing of start the backward movement of the cutter holder 51 may be before a start of conveying the next-conveyed sheet 90 or may be after the start of conveying the next-conveyed sheet 90.

The medium-cutting device 5 of the present embodiment can reduce the occurrence of the ejection jam even if the rolled sheet 30 remains on the ejection guide plate 80 because of charging of the rolled sheet 30 or curl of the rolled sheet 30. The curl of the rolled sheet 30 occurs when remaining amount of sheet is less, and the curled sheet may be easily caught by the ejection guide plate 80. If is thereby possible to prevent rubbing of image by the cut sheet 91 and prevent fading of quality of printed image.

Further, conveying of the next-conveyed sheet 90 is performed while pushing part 206 of the cutter holder 51 push up the trailing end 910 of the cut sheet 91. Thereby, it is possible to push the trailing end 910 of the cut sheet 91 with the leading end 900 of the next-conveyed sheet 90 while avoiding the leading end 900 of the next-conveyed sheet 90 to be piled on the trailing end 910 of the cut sheet 91. Thereby, it is possible to ensure the discharging operation of the rolled sheet 30. Because the cut sheet 91 is pushed by the next-conveyed sheet 90 while the cutter holder 51 pushes up the cut sheet 91, the ejection operation of the cut sheet 91 is easily performed by the kinetic friction occurred between the cut sheet 91 and the ejection guide plate 80 even if the cut sheet 91 sticks to the ejection guide plate 80 by the static electricity.

Thus, the cutter holder 51 does not catch the next-conveyed sheet 90 while conveying the next-conveyed sheet 90 during the backward movement of the cutter holder 51. Therefore, the inkjet printer 1 can eject the cut sheet 91 smoothly while preventing the ejection failure owing to the stacking (piling) of the cut sheet 91.

In the present embodiment, the guide member includes the platen 36, the ejection guide plate 80, and the ejection guide cover 81. However, the configuration of the guide member is not limited to the configuration described above such that the guide member may include other members.

Next a second embodiment of the medium-cutting device 5 of the present disclosure is described below.

Figure 8A:
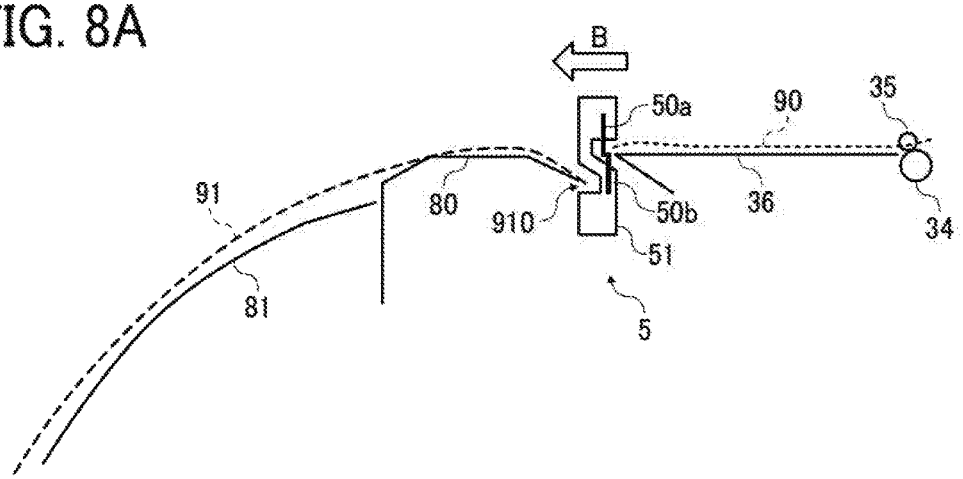
FIGS. 8A to 8C are schematic side views of the medium-cutting device according to still another embodiment of the present disclosure.
Figure 8B:
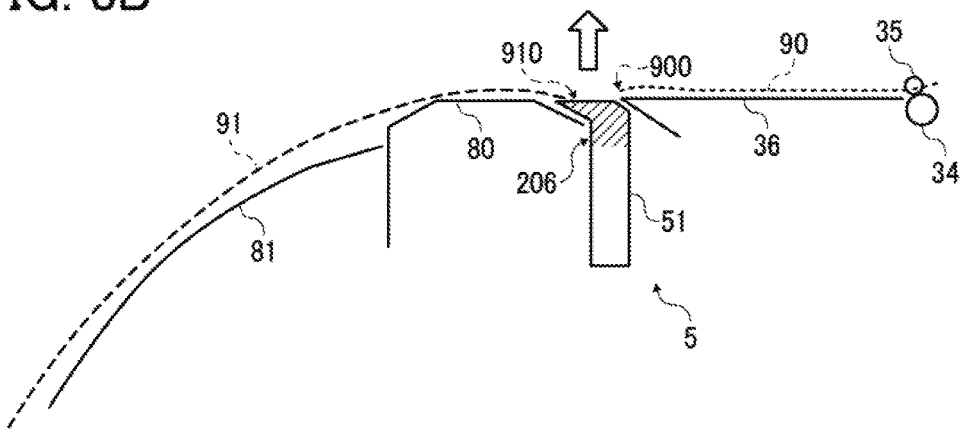
Figure 8C:
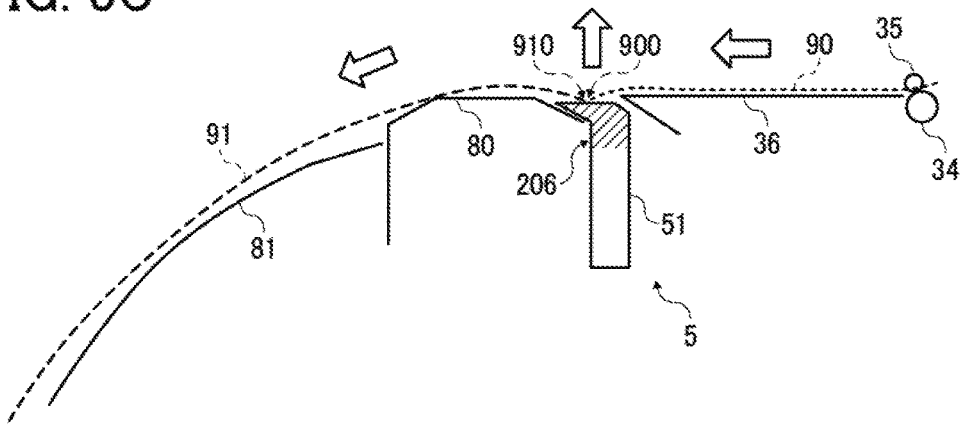

FIGS. 8A to 8C are schematic side views (view from the sheet width direction A of the rolled sheet 30) illustrating the medium-cutting device 5 according to the present embodiment. FIG. 8A exemplary illustrates a state where the cutter holder 51 (and cutter 50) cuts the rolled sheet 30 while moving along the forward path FWD.

As illustrated in FIG. 8A, the rolled sheet 30 is nipped and conveyed by the conveyance roller 34 and the registration pressure roller 35 while suctioned by a platen 36. The rolled sheet 30 is conveyed across the forward path FWD of the cutter holder 51. The rolled sheet 30 is conveyed in the guide direction (medium-conveyance direction) as indicated in the arrow B. The cutter holder 51 in the cutting mode moves along the pathway 203 to cut the rolled sheet 30 when the rolled sheet 30 is conveyed in the medium-conveyance direction B for a predetermined length.

The trailing end 910 of the cut sheet 91 hangs down toward a lower side of the pathway 203 along an ejection guide plate 80. The cut sheet 91 is a piece of the rolled sheet 30 cut from the rolled sheet 30. Here, the second embodiment is different from the first embodiment in that the cutter holder 51 of the second embodiment stops at a middle (center part) of the sheet width SW (See FIG. 3) of the rolled sheet 30 while the cutter holder 51 returns to the home position along the backward path BWD as illustrated in FIG. 8B. When the cutter holder 51 stops at the middle (center part) of the sheet width SW, the cutter holder 51 keeps pushing the trailing end 910 of the cut sheet 91.

While the cutter holder 51 is stopped at the middle (about center) of the backward path BWD to keep pushing the trailing end 910 of the cut sheet 91, the next-conveyed sheet 90 is conveyed to the medium-cutting device 5 in the medium-conveyance direction B. Then, the cut sheet 91 and the next-conveyed sheet 90 becomes the state as illustrated in FIG. 8C. Because the rolled sheet 30 is curled in a predetermined direction, the leading end 900 of the next-conveyed sheet 90 and the trailing end 910 of the cut sheet 91 are curled in same direction. The curled trailing end 910 and the curled leading end 900 form a line of contact with each other on the top surface of the cutter holder 51 without overlapping. Thus, if is possible to ensure the ejection of the cut sheet 91 because the leading end 900 of the next-conveyed sheet 90 pushes the trailing end 910 end-on-end; i.e., while maintaining a line of contact spanning the entire end of the cut sheet.

Figure 9:
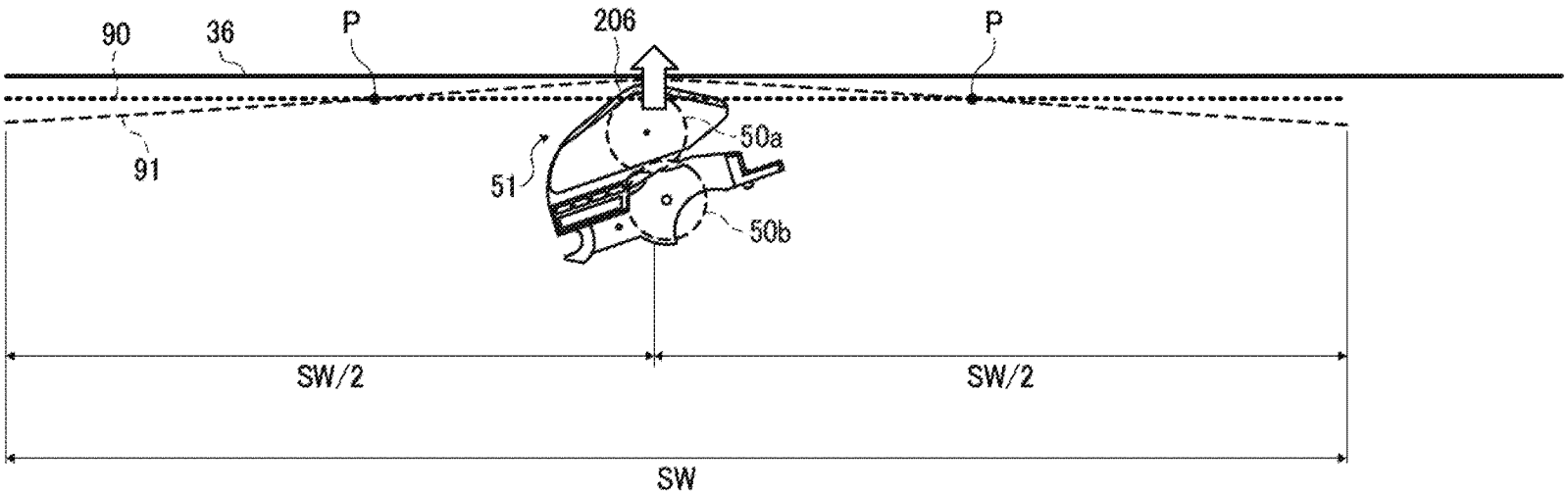
FIG. 9 is a front view of the medium-cutting device.

FIG. 9 is a schematic front view of the cutter holder 51 in the present embodiment. FIG. 9 illustrates a state that the cutter holder 51 stops at about the center of the sheet width SW of the rolled sheet 30 (about halfway of the sheet width SW) in the sheet width direction A on the way to return to the home position along the backward path BWD. In this case, the center part of the cut sheet 91 in the sheet width SW is pushed up by the cutter holder 51. Thus, the trailing end 910 of the cut sheet 91 is bent such that the center part of the cut sheet 91 has upward convex surface and has slopes gradually declining toward each ends of the cut sheet 91 in the sheet width direction A. On the other hand, the leading end 900 of the next-conveyed sheet 90 forms a straight across the width of the sheet; i.e., in the sheet width direction A.

Therefore, the trailing end 910 of the cut sheet 91 and the leading end 900 of the next-conveyed sheet contact at the points P as illustrated in FIG. 9 without piling up with each other in the medium-conveyance direction B. Thereby, the cut sheet 91 is pushed out by the nest-conveyed sheet 90. Further, the cut sheet 91 is pushed straightly because the center part of the cut sheet 91 is pushed by the next-conveyed sheet 90. Thus, if there is a stacker in a downstream of the medium-conveyance direction B of the medium-cutting device 5, stack performance is increased.

The cutter holder 51 according to the embodiment as described above can easily push out the cut sheet 91 with the next-conveyed sheet 90. If is because the cutter holder 51 keeps the trailing end 910 of the cut sheet 91 to be pushed-up state by temporality stopping the backward movement of the cutter holder 51 to the home position. In this case, because the center part of the cut sheet 91 in the sheet width direction A is pushed out, it is possible to straightly eject the cut sheet 91 to fall down to the ejection guide cover 81. Thus, it is possible to improve the stack performance of the cut sheet 91 by straightly discharging the cut sheet 91.

It is not necessarily stop the cutter holder 51 while conveying the next-conveyed sheet 90 in the present embodiment. For example, the similar effect as described above may be obtained by reducing the moving speed of the cutter holder 51 in the vicinity of the center part of the sheet width SW of the cut sheet 91.

Next, a third embodiment of the medium-cutting device 5 of the present disclosure is described below.

Figure 10:
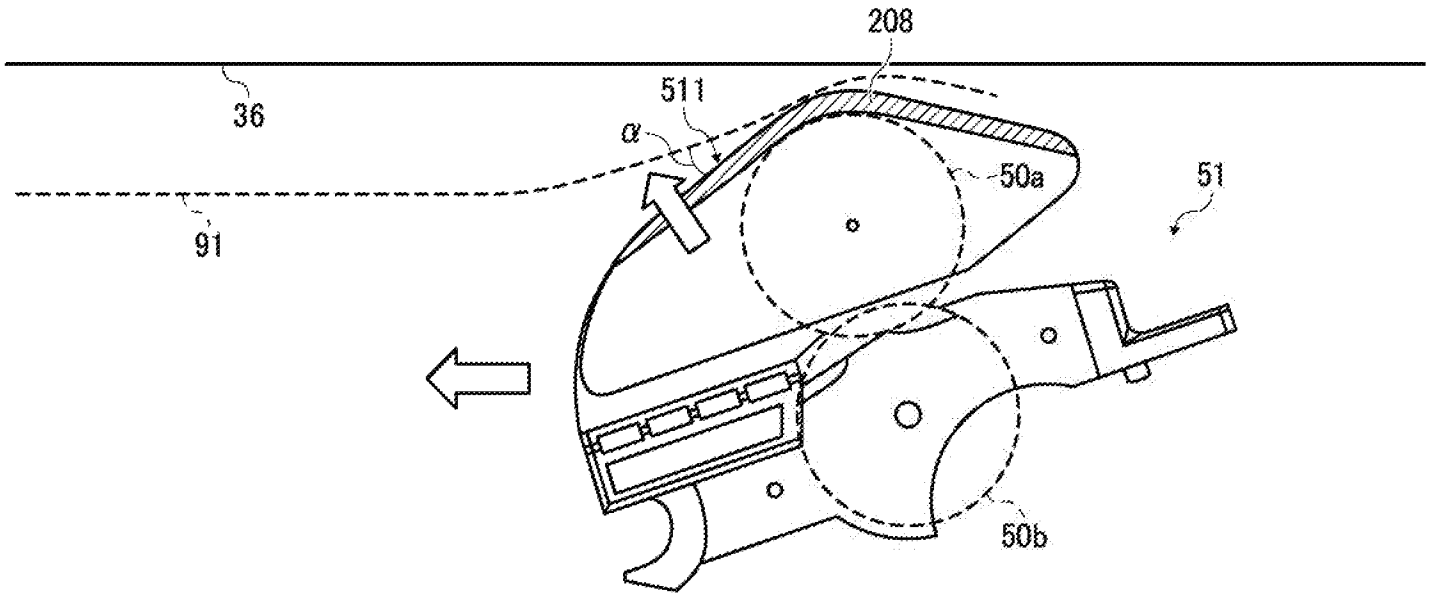
FIG. 10 is a front view of a medium-cutting device according to still another embodiment of the present disclosure.

FIG. 10 is a schematic front view (a view from the medium-conveyance direction A of the rolled sheet 30) of the medium-cutting device 5 according to the present embodiment. As illustrated in FIG. 10, the medium-cutting device 5 includes a pushing part 208 to push the cut sheet 91 while the cutter holder 51 performs backward movement along the backward path BWD to the home position. Specifically a top surface of the cutter holder 51 acts as a pushing part 208. A taper part 511 is formed on the top surface of the cutter holder 51. The taper part 511 lifts an end of the cut sheet 91 in the sheet width direction. The end of cut sheet 91 is lifted upward by the pushing part 208 while the end of cut sheet 91 slips on the taper part 511.

When the pushing part 208 is contact with the cut sheet 91, an angle $\alpha$ as illustrated in FIG. 10 is less than 90 degree. The angle $\alpha$ is the angle formed by a surface on which the pushing part 208 contact with the cut sheet 91 (that is, a surface of the taper part 511) and the surface of the cut sheet 91.

The cutter holder 51 according to the third embodiment as described above lifts up the end of cut sheet 91 to crawl under the cut sheet 91 and then lifts up the cut sheet 91 while performing backward movement to the home position. Thus, the cutter holder 51 of the third embodiment can prevent stack failure of the cut sheet 91 and eject the cut sheet 91 smoothly.

Next, a still another embodiment of the medium-cutting device 5 according to the present disclosure is described below.

Figure 11A:
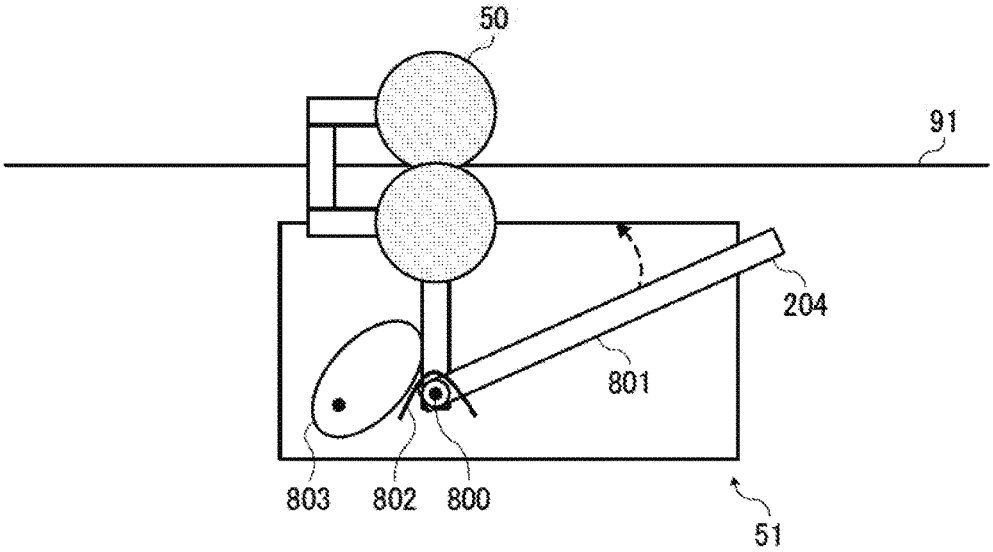
FIGS. 11A and 11B are front views of a medium-cutting device according to still another embodiment of the present disclosure.
Figure 11B:
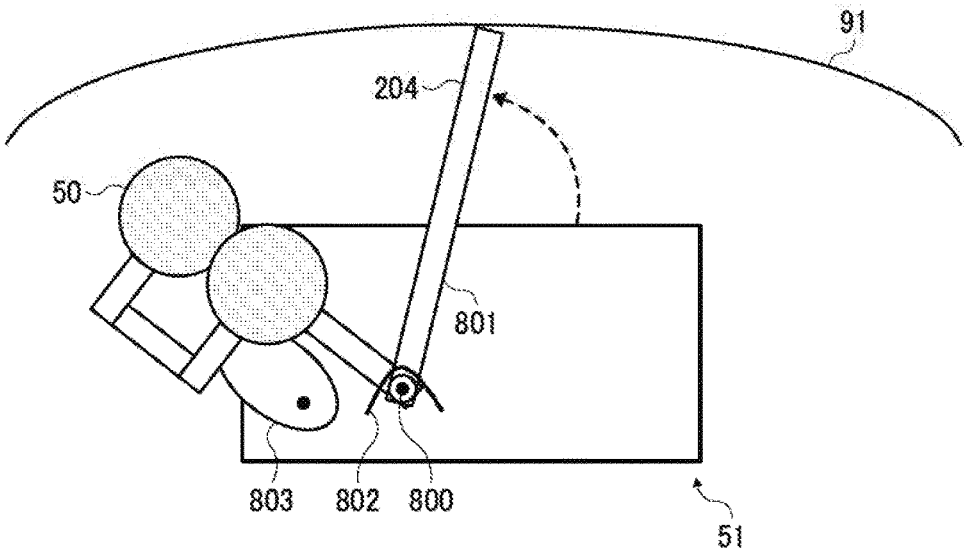

FIGS. 11A and 11B are a schematic front view (a view from the medium-conveyance direction A of the rolled sheet 30) of the medium-cutting device 5 according to the present embodiment. The cutter holder 51 of the fourth embodiment has base 801, a cutter 50 provided at first end of the base 801, and a pushing part 204 provided at second end of the base 801. The cutter holder 51 is in cutting mode to cut the rolled sheet 30 with the cutter 50 in FIG. 11A. In cutting mode, the base 801 is pushed toward a direction indicated by broken-line arrow in FIG. 11A with a spring 802.

With the rotation of the base 801 with a rotation axis 800 as a rotation center 800, the cutter holder 51 is switched to a pushing mode M2 where the pushing part 204 pushes the cut sheet 91. In a fourth embodiment, a cam 803 rotated by a driving source lets the spring 802 rotate the base 801 in the direction indicated by a broken-line arrow, thereby sending the pushing part 204 upward.

Thus, switching the modes is not limited to a changing of the attitude or the position of the cutter holder 51. The fourth embodiment can switch modes without changing the attitude of the cutter holder 51. In the fourth embodiment, it is not necessary to change the attitude of the cutter holder 51, and thus the fourth embodiment can save space. The configuration using cam 803 and base 801 in the fourth embodiment is one example, and other known techniques or configurations may be used to achieve the same effect.

The pushing parts 204, 206, and 208 may be constituted as a member separate from the cutter holder 51 in each embodiments described above. At least if the pushing parts 204, 206, and 208 are provided separately with the guide member (such as platen 36) and if the cut sheet 91 (a piece of medium cut from the rolled sheet 30) can be pushed up by the pushing part 204, 206, and 208, a conveying failure can be avoided. Further, the medium-cutting device 5 is not limited to the cutter that reciprocally moves.

The present disclosure includes a method for conveying medium. The method includes conveying a first medium and a second medium in a conveyance direction, the second medium being disposed upstream of the first medium in the conveyance direction, bending a trailing end of the first medium by pushing up the trailing end of the first medium with a pushing part, conveying trailing end of the second medium in the conveyance direction after the bending of the trailing end of the first medium, and pushing the first medium by contacting the leading end of the second medium with the trailing end of the first medium to convey the first medium.

The present disclosure may include the following embodiments.

As the image forming apparatus, not only an inkjet type but also an electrophotographic type may be used.

In the present disclosure, discharged "liquid" is not limited to a particular liquid as long as the liquid has a viscosity or surface tension to be discharged from a liquid discharge head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication. Examples of the liquid are, e.g., ink, treatment liquid, DNA sample, resist, pattern material, binder, mold liquid, or solution and dispersion liquid including amino acid, protein, or calcium.

"A liquid discharge head" includes an energy source. Examples of the energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

"The liquid discharge apparatus" includes a liquid discharge device that drives the liquid discharge head to discharge liquid. The liquid discharge apparatus may be, for example, an apparatus capable of discharging liquid to a material, to which liquid can be adhered, or an apparatus to discharge liquid toward gas or into liquid.

The liquid discharge apparatus may include devices to convey, convey, and discharge the medium on which liquid can adhere. The liquid discharge apparatus may further include a pretreatment apparatus to coat a treatment liquid onto the medium, and a post-treatment apparatus to coat a treatment liquid onto the medium, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

In addition, the liquid discharge apparatus is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "medium on which liquid can be adhered" represents a medium on which liquid is at least temporarily adhered, a medium on which liquid is adhered and fixed, or a medium into which liquid is adhered to permeate. Examples of the "medium on which liquid can be adhered" include recording media, such as paper sheet, recording paper, recording sheet of paper, film, and cloth, electronic component, such as electronic-substrate and piezoelectric element, and media, such as powder layer, organ model, and testing cell. The "medium on which liquid can be adhered" includes any medium on which liquid is adhered, unless particularly limited.

Examples of "the medium on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a liquid discharge head and a medium on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of "the liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A medium-cutting device, comprising:

a medium-conveyance section to convey a medium in a medium-conveyance direction;

a cutter to cut the medium conveyed by the medium-conveyance section;

a pushing part that pushes up a cut piece of the medium that is cut from the medium with the cutter; and a guide member to guide the medium in the medium-conveyance direction, wherein the guide member includes an upstream-side guide member disposed upstream of the pushing part in the medium-conveyance direction and a downstream-side guide member disposed downstream of the pushing part in the medium-conveyance direction, and wherein the pushing part is disposed below a downstream end of the upstream-side guide member and is disposed above an upstream end of the downstream-side guide member.

2. The medium-cutting device according to claim 1, wherein the pushing part pushes up the cut piece such that a trailing end of the cut piece contacts a leading end of the medium disposed upstream of the cut piece in the medium-conveyance direction.

3. The medium-cutting device according to claim 1, wherein the medium-conveyance section conveys the medium while the pushing part pushes up the cut piece.

4. The medium-cutting device according to claim 1, wherein the cutter is disposed in a pathway perpendicular to the medium-conveyance direction, and wherein the cutter cuts the medium by moving along the pathway while the medium is on the pathway.

5. The medium-cutting device according to claim 4, further comprising a cutter holder to hold the cutter, wherein the cutter holder is switchable between a cutting mode to cut the medium with the cutter and a pushing mode to push up the cut piece with the pushing part.

6. The medium-cutting device according to claim 5, wherein a top portion of the cutter is flush with a top surface of the medium in the cutting mode, and wherein the top portion of the pushing part is lower than a trailing end of the cut piece in the pushing mode.

7. The medium-cutting device according to claim 5, wherein the medium-conveyance section conveys the medium, when the pushing part supports a center part of the cut piece in a direction perpendicular to the medium-conveyance direction.

8. The medium-cutting device according to claim 5, wherein the pushing part is a top surface of the cutter holder.

9. The medium-cutting device according to claim 1, wherein an angle $\alpha$ formed between the pushing part and the cut piece when the pushing part is in contact with the cut piece is less than ninety degrees.

10. The medium-cutting device of claim 1, further comprising a motor to move the pushing part to push up the cut piece.

11. An image forming apparatus, comprising:

an image forming section to form an image on a medium;

a medium-conveyance section to convey the medium to the image forming section in a medium-conveyance direction;

a cutter to cut the medium, on which the image is formed by the image forming section, conveyed by the medium-conveyance section;

a pushing part that pushes up a cut piece of the medium that is cut from the medium with the cutter; and a guide member to guide the medium in the medium-conveyance direction, wherein the guide member includes an upstream-side guide member disposed upstream of the pushing part in the medium-conveyance direction and a downstream-side guide member disposed downstream of the pushing part in the medium-conveyance direction, and wherein the pushing part is disposed below a downstream end of the upstream-side guide member and is disposed above an upstream end of the downstream-side guide member.

12. The medium-cutting device according to claim 11, wherein the pushing part pushes up the cut piece such that a trailing end of the cut piece contacts a leading end of the medium disposed upstream of the cut piece in the medium-conveyance direction.

13. The medium-cutting device according to claim 11, wherein the medium-conveyance section conveys the medium while the pushing part pushes up the cut piece.

14. The medium-cutting device according to claim 11, wherein the cutter is disposed in a pathway perpendicular to the medium-conveyance direction, and wherein the cutter cuts the medium by moving along the pathway while the medium is on the pathway.

15. The medium-cutting device according to claim 14, further comprising a cutter holder to hold the cutter, wherein the cutter holder is switchable between a cutting mode to cut the medium with the cutter and a pushing mode to push up the cut piece with the pushing part.

16. The medium-cutting device according to claim 15, wherein a top portion of the cutter is flush with a top surface of the medium in the cutting mode, and wherein the top portion of the pushing part is lower than a trailing end of the cut piece in the pushing mode.

17. The medium-cutting device according to claim 15, wherein the medium-conveyance section conveys the medium, when the pushing part supports a center part of the cut piece in a direction perpendicular to the medium-conveyance direction.

18. The medium-cutting device according to claim 15, wherein the pushing part is a top surface of the cutter holder.

19. The medium-cutting device according to claim 11, wherein an angle $\alpha$ formed between the pushing part and the cut piece when the pushing part is in contact with the cut piece is less than ninety degrees.

* * * * *